US011149228B2

(12) United States Patent
Ramakrishna et al.

(10) Patent No.: US 11,149,228 B2
(45) Date of Patent: Oct. 19, 2021

(54) GREASE COMPOSITIONS AND METHOD FOR MAKING THE SAME

(71) Applicant: Aktiebolaget SKF, Gothenburg (SE)

(72) Inventors: Sathwik Chatra Kalsanka Ramakrishna, Nieuwegein (NL); Dries Muller, Schwaz (AT)

(73) Assignee: AKTIEBOLAGET SKF, Gothenburg (SE)

( * ) Notice: Subject to any disclaimer, the term of this patent is extended or adjusted under 35 U.S.C. 154(b) by 72 days.

(21) Appl. No.: 15/837,127

(22) Filed: Dec. 11, 2017

(65) Prior Publication Data

US 2018/0171260 A1 Jun. 21, 2018

(30) Foreign Application Priority Data

Dec. 15, 2016 (IN) ..... 201641042773

(51) Int. Cl.

| | |
|---|---|
| ***C10M 169/02*** | (2006.01) |
| ***C10M 169/06*** | (2006.01) |
| ***C10M 101/00*** | (2006.01) |
| ***C10M 105/32*** | (2006.01) |
| ***C10M 119/02*** | (2006.01) |
| ***C10M 119/24*** | (2006.01) |
| *C10N 20/04* | (2006.01) |
| *C10N 30/06* | (2006.01) |
| *C10N 30/12* | (2006.01) |
| *C10N 40/02* | (2006.01) |
| *C10N 40/04* | (2006.01) |
| *C10N 50/10* | (2006.01) |

(52) U.S. Cl.

CPC ..... *C10M 169/02* (2013.01); *C10M 101/00* (2013.01); *C10M 105/32* (2013.01); *C10M 119/02* (2013.01); *C10M 119/24* (2013.01); *C10M 169/06* (2013.01); *C10M 2203/003* (2013.01); *C10M 2205/022* (2013.01); *C10M 2205/024* (2013.01); *C10M 2205/026* (2013.01); *C10M 2205/0206* (2013.01); *C10M 2205/0213* (2013.01); *C10M 2205/0225* (2013.01); *C10M 2205/0245* (2013.01); *C10M 2205/0265* (2013.01); *C10M 2207/2805* (2013.01); *C10M 2217/0446* (2013.01); *C10N 2020/04* (2013.01); *C10N 2030/06* (2013.01); *C10N 2030/12* (2013.01); *C10N 2040/02* (2013.01); *C10N 2040/04* (2013.01); *C10N 2050/10* (2013.01)

(58) Field of Classification Search

CPC ..... C10M 2207/28; C10M 2207/282; C10M 169/02; C10M 169/06; C10M 101/00; C10M 105/32; C10M 119/02; C10M 119/24; C10M 2203/003; C10M 2205/024; C10M 2207/2805; C10M 2217/0446; C10N 2250/10

USPC ..... 508/476, 477

See application file for complete search history.

(56) References Cited

U.S. PATENT DOCUMENTS

| | | | | |
|---|---|---|---|---|
| 2,830,954 | A | 4/1958 | Dixon | |
| 2,830,955 | A | 4/1958 | Dixon | |
| 4,448,700 | A | 5/1984 | Lankamp | |
| 4,720,517 | A * | 1/1988 | Ravichandran | C08K 5/32 508/477 |
| 4,749,502 | A | 6/1988 | Alexander et al. | |
| 5,023,283 | A * | 6/1991 | Ravichandran | C07C 229/12 106/170.1 |
| 5,578,089 | A | 11/1996 | Elsamaloty | |
| 5,674,567 | A | 10/1997 | Kausch et al. | |
| 5,773,394 | A * | 6/1998 | Wan | C10M 119/02 508/591 |
| 5,783,657 | A * | 7/1998 | Pavlin | A61K 8/042 524/600 |
| 5,998,570 | A * | 12/1999 | Pavlin | A61K 8/042 431/288 |
| 6,423,304 | B1 | 7/2002 | Shah et al. | |
| 6,489,272 | B2 * | 12/2002 | Gatlin | C09K 8/035 508/452 |
| 2002/0187170 | A1 * | 12/2002 | Pavlin | A61K 8/042 424/401 |
| 2003/0008782 | A1 | 1/2003 | Endou et al. | |
| 2003/0126788 | A1 | 7/2003 | Uang et al. | |
| 2003/0162938 | A1 | 8/2003 | Pavlin et al. | |
| 2003/0223943 | A1 | 12/2003 | Uang et al. | |

(Continued)

FOREIGN PATENT DOCUMENTS

| | | | |
|---|---|---|---|
| CA | 1148926 | A | 6/1983 |
| CN | 1670144 | A | 9/2005 |

(Continued)

OTHER PUBLICATIONS

Chevron, chevronbasoils.com (Year: 2013).

(Continued)

*Primary Examiner* — Ellen M McAvoy

(74) *Attorney, Agent, or Firm* — J-Tek Law PLLC; Jeffrey D. Tekanic; Scott T. Wakeman

(57) ABSTRACT

A grease composition contains a mixture of a lubricating base oil, an ester-terminated polyamide and at least one polyolefin. The ester-terminated polyamide has the formula:

R1-O—CO—R2-CO—[NH—R3-NH—CO—R2-CO]*n*-O—R1.

R1 contains 4-22 carbon atoms, R2 contains 4-42 carbon atoms, R3 contains 2-9 carbon atoms and n is an integer in the range of 1-20. The grease composition can be used for lubricating a mechanical component having a metal surface and/or for protecting a mechanical component having a metal surface against corrosion, wear and/or fretting.

20 Claims, No Drawings

(56) References Cited

U.S. PATENT DOCUMENTS

| | | | | |
|---|---|---|---|---|
| 2004/0121162 | A1 | 6/2004 | Yamaoka et al. | |
| 2005/0205341 | A1 | 9/2005 | Kitahata et al. | |
| 2006/0229222 | A1* | 10/2006 | Muller | C10L 1/143 510/267 |
| 2007/0000807 | A1* | 1/2007 | Wu | C10M 107/02 208/18 |
| 2008/0182770 | A1 | 7/2008 | Ramsey | |
| 2009/0065287 | A1* | 3/2009 | Kuwabara | C10M 169/00 180/444 |
| 2012/0149613 | A1 | 6/2012 | David et al. | |
| 2013/0006175 | A1 | 1/2013 | Elton | |
| 2013/0130953 | A1* | 5/2013 | Spagnoli | C10M 115/08 508/136 |
| 2013/0331307 | A1* | 12/2013 | Meijer | C10M 169/06 508/534 |
| 2014/0011718 | A1* | 1/2014 | Meijer | C10M 169/06 508/100 |
| 2014/0113847 | A1 | 4/2014 | Givens et al. | |
| 2014/0142232 | A1 | 5/2014 | Bond et al. | |
| 2014/0329729 | A1 | 11/2014 | Becker-Willinger et al. | |
| 2015/0024981 | A1* | 1/2015 | Ayame | C10M 169/06 508/155 |
| 2015/0232778 | A1* | 8/2015 | Arai | C10M 141/06 180/444 |
| 2015/0368583 | A1* | 12/2015 | Meijer | C10M 169/02 508/591 |
| 2016/0130523 | A1 | 5/2016 | Holsnijders et al. | |
| 2017/0321144 | A1 | 11/2017 | Fiddelaers et al. | |
| 2017/0343045 | A1* | 11/2017 | Asai | C10M 115/08 |
| 2017/0349854 | A1* | 12/2017 | Nakakawaji | C10M 169/02 |
| 2017/0362527 | A1 | 12/2017 | Fiddelaers et al. | |
| 2018/0016517 | A1* | 1/2018 | Sawaguchi | C10M 169/00 |
| 2018/0171256 | A1 | 6/2018 | Meijer et al. | |
| 2018/0171260 | A1 | 6/2018 | Ramakrishna et al. | |
| 2018/0282654 | A1 | 10/2018 | Abraham et al. | |

FOREIGN PATENT DOCUMENTS

| | | | |
|---|---|---|---|
| CN | 101622333 | A | 1/2010 |
| CN | 103403138 | A | 11/2013 |
| CN | 104919030 | A | 9/2015 |
| CN | 105229130 | A | 1/2016 |
| EP | 1453885 | A1 | 9/2004 |
| EP | 2053073 | A2 | 4/2009 |
| FR | 2808281 | A1 | 11/2001 |
| GB | 774085 | A | 5/1957 |
| JP | 2001164282 | A | 6/2001 |
| JP | 2008038047 | A | 2/2008 |
| WO | 9817243 | A1 | 4/1998 |
| WO | 2014108438 | A1 | 7/2014 |
| WO | 2015016259 | A1 | 2/2015 |
| WO | 2016077134 | A1 | 5/2016 |

OTHER PUBLICATIONS

Combined Search and Examination Report dispatched Feb. 1, 2016 in related UK application No. GB1513789.6.

Combined Search and Examination Report dispatched Feb. 2, 2016 in related UK application No. GB1513790.4.

Non-Final Office Action dated Oct. 7, 2019 in related U.S. Appl. No. 15/837,117.

Product Brochure of Arizona Chemical entitled "Hot Melt Polyamide Adhesives"; Jul. 2011.

Notice of Allowance dated Apr. 16, 2020 in related U.S. Appl. No. 15/837,117, including Notice of Allowability, Reasons for Allowance, Search Notes, Issue Classification and allowed claims 1-11 and 16-24.

Search Report and Written Opinion from the French Patent Office dispatched Oct. 7, 2020 in counterpad French application No. 1761785, with attached translation thereof.

Office Action dated Apr. 30, 2021 in related U.S. Appl. No. 15/837,117.

Office Action dated Jan. 25, 2021 in related Indian patent application No. 201641042773.

Office Action dated Mar. 17, 2021 in related Indian patent application No. 201641042772.

Non-Final Office Action dated Aug. 6, 2021 in related U.S. Appl. No. 15/837,117.

Office Action dated Jun. 15, 2021 in counterpart CN application No. 201711318501.4, and English translation thereof.

Office Action dated Jun. 15, 2021 in related CN application No. 201711334153.X, and English translation thereof.

* cited by examiner

GREASE COMPOSITIONS AND METHOD FOR MAKING THE SAME

CROSS-REFERENCE TO RELATED APPLICATIONS

This application claims priority to Italian patent application no. IN201641042773 filed on Dec. 15, 2016, the contents of which are fully incorporated herein by reference.

FIELD OF THE PRESENT INVENTION

The present invention relates to a grease composition; and a method for preparing the grease composition. The invention also relates to the use of the grease composition for lubricating a mechanical component having a metal surface; and the use of the grease composition for protecting a mechanical component having a metal surface against corrosion, wear and/or fretting.

BACKGROUND

Grease compositions are widely used for lubricating bearings and other structural components. A grease is an essential product to reduce, for example, wear, friction, corrosion, running temperatures and energy losses.

Greases are materials which comprise a base oil that is thickened, for example using a metal soap or calcium sulfonate as thickening agent. This provides greases with the desired physical and chemical structure needed for sustained lubrication of machine elements under rolling or sliding conditions, as is the case in rolling bearings. There are a number of grease thickeners available, each with its own strengths and weaknesses. Briefly, typical lithium-based greases (the most common) are made from a fatty acid, usually 12-hydroxystearic acid, and a lithium base to produce a simple soap which acts as the grease thickener. In lithium-complex greases, part of the fatty acid is replaced with another acid (usually a diacid), which makes the complex soap. Calcium sulfonate greases can be used as an alternative for soap-based greases. They have the potential of providing high performance without the presence of additives.

Components are added to grease to provide essential extreme-pressure/anti-wear performance, and other desirable properties that allow equipment to run at peak performance. The function of such additives is to minimize wear, and to prevent scuffing and welding between contacting surfaces. Additives may also form a friction-reduction film following the physical-chemical reaction of the additives on the lubricated metal surface, resulting in desired properties of reducing friction and operating temperature.

An important performance benefit of grease compositions lies in the use of synergetic components. It is highly desirable that the additives incorporated, but also the thickening agent, (i) provide a synergetic improvement of different properties such as extreme pressure/anti-wear properties, friction reduction, and corrosion protection; (ii) prevent a negative impact on other properties, for example lubricant film formation, or grease mechanical stability, or low temperature performance, (iii) achieve the desired performance at the lowest possible overall additive concentration.

In many applications, exposure to water or high humidity levels requires the use of greases that are highly effective in protecting against corrosion. Anti-corrosion additives are often surfactants that neutralize acids on the surface of metal. These can also repel water by creating absorption to form an oil-like surface, or by providing a barrier through incorporation in a physical-chemical surface-film.

Conventional greases such as lithium 12-hydroxide stearate-based grease compositions leave room for improvement in terms of anti-friction and anti-corrosion properties. Due to the strong polar interaction between thickener and lubricated surface, the effectiveness of grease additives is reduced, or alternatively, effective performance can only be achieved by increasing the additive concentration.

Calcium sulfonate thickened greases can be used as an alternative for soap-based greases. They have the potential of providing high performance without the presence of additional additives, owing to the interaction with the metal surface, and the neutralizing ability, of the calcium sulfonate thickener. They combine properties of a good mechanical stability, very strong extreme-pressure/anti-wear performance, and excellent rust protection. Although calcium sulfonate greases have desirable properties, the downside is the high concentration of calcium sulfonate concentration needed to thicken the grease, as well as raw material cost. The thickener concentration may vary to values as high as 20 to 50 percent in greases.

Conventional grease compositions have the additional drawback, that due to mechanical shearing they become in the course of time a permanent liquid, resulting in a deterioration of their lubricating performance.

In grease-lubricated bearings, lubrication conditions deteriorate over time due to grease hardening, grease aging, and oil depletion from grease fractions stored close to the rolling contact. It is generally acknowledged that greases are sensitive to physical and chemical aging, and that this is an irreversible process. Inherent properties of greases, therefore, are a loss of effectiveness in replenishing the rolling contact.

In bearings, greases suffer from a (relatively) unfavourable grease distribution, where a small fraction positioned close to the rolling contact drives the lubrication performance, while a larger fraction of grease is inactive in the lubrication process. Essentially, this leads to insufficient grease/oil replenishment in applications in due time. Due to grease ageing/hardening, replenishing grease by re-lubrication can be difficult.

Generally, grease manufacturing is a complex and energy-intensive process. Performance reliability and product quality require extensive experience and in-depth knowledge of process technology.

BRIEF SUMMARY OF THE PRESENT INVENTION

Object of the present invention is to provide a grease composition which displays an improved lubricating performance when compared with conventional grease compositions.

It has now been found that that this object can be established when the grease composition comprises a particular thickener.

Accordingly, the present invention relates to a grease composition comprising a lubricating base oil and a thickener, which thickener comprises an ester-terminated oligomer and a polymer, wherein the polymer is a polyolefin, and wherein the ester-terminated oligomer has the general formula $$R1\text{-}O\text{—}CO\text{—}R2\text{-}CO\text{—}[NH\text{—}R3\text{-}NH\text{—}CO\text{—}R2\text{-}CO]_n\text{—}O\text{—}R1,$$

wherein R1 each independently represents a hydrocarbon group containing 4-22 carbon atoms; R2 represents a hydrocarbon group containing 4-42 carbon atoms, noting that at least 50% of the R2 groups have 30-42 carbon atoms; R3 represents a hydrocarbon group containing 2-9 carbon atoms, in addition to hydrogen atoms, and optionally containing one or more oxygen and nitrogen atoms; and n represents an integer in the range of 1-20, and wherein the weight ratio of the lubricating base oil to the ester terminated oligomer (oil/oligomer) is larger than 1.

The grease compositions according to the present invention have the advantage that they display an improved lubricating performance when compared with conventional grease compositions. This improvement is established by the mechanical properties of the thickener which bring about less grease ageing. The thickener promotes the formation of a porous, oil-retaining layer on the surface of the mechanical component to be lubricated. In turn, this layer promotes the formation of a lubricant film on the mechanical component which reduces the risk of surface fatigue, and leads to reduced wear. Further, the thickener displays an excellent solubility in the lubricating base oil. In addition, as a result of the improved lubricating performance of the present grease composition the amount of aggressive additives otherwise needed can suitably be decreased or even be avoided.

DETAILED DESCRIPTION OF THE PRESENT INVENTION

The composition according to the present invention comprises a lubricating base oil and a thickener which comprises an oligomer and a polymer.

Preferably, the present grease composition comprises:

(a) 75 to 90 wt. % of the lubricating base oil;

(b) 1 to 19 wt. % of the ester-terminated oligomer; and (c) 1 to 19 wt. % of the polymer which is a polyolefin, all weights based on the total weight of the grease composition.

More preferably, the present grease composition comprises:

(a) 76-84 wt. % of the lubricating base oil;

(b) 11-15 wt. % of the ester-terminated oligomer; and (c) 5-9 wt. % of the polymer which is a polyolefin, all weights based on the total weight of the grease composition.

R1 represents a hydrocarbon group containing 4-22 carbon atoms. The hydrocarbon group may be a straight or branched hydrocarbon group, the hydrocarbon group may a single chain hydrocarbon group or a multiple chain hydrocarbon group; the hydrocarbon group may be a saturated or unsaturated hydrocarbon group; and/or the hydrocarbon group may be a substituted or a non-substituted hydrocarbon group. In case the hydrocarbon group is a substituted hydrocarbon group the hydrocarbon group may contain an additional functional group such as for instance acid, alcohol or amine group. Preferably, R1 represents an unsubstituted hydrocarbon group.

Preferably, R1 represents a hydrocarbon group which is derived from a monoalcohol. Suitable examples of monoalcohols from which R1 can suitably be derived include stearyl alcohol, palmetyl alcohol, lauryl alcohol and oleyl alcohol. The monoalcohol is preferably stearyl alcohol or oleyl alcohol. More preferably, R1 is derived from stearyl alcohol. Suitably, R1 represents a hydrocarbon group that contains 4-22 carbon atoms, preferably 4-20 carbon atoms and more preferably 1-18 carbon atoms.

R2 represents a hydrocarbon group containing 4-42 carbon atoms. The hydrocarbon group may be a straight or branched hydrocarbon group; the hydrocarbon group may be a single chain hydrocarbon group or a multiple chain hydrocarbon group; the hydrocarbon group may be a saturated or unsaturated hydrocarbon group; and/or the hydrocarbon group may be a substituted or a non-substituted hydrocarbon group. In case the hydrocarbon group is a substituted hydrocarbon group the hydrocarbon group may contain an additional functional group such as for instance an alcohol, amine and/or carboxylic acid group. Suitably, R2 represents a hydrocarbon group that is substituted with a carboxylic acid group.

Preferably, R2 represents a hydrocarbon group which is derived from a diacid, a triacid, a dimer acid or a trimer acid. Preferably, R2 represents a hydrocarbon group which is derived from a diacid. Suitable examples of diacids from which R2 can suitably be derived include glutaric acid, adipic acid, pimelic acid, azealic acid, sebacic acid or barssylic acid Preferably, R2 is derived from glutaric acid, adipic acid, pimelic acid, azealic acid, sebacic acid or barssylic acid. More preferably, the diacid is derived from adipic acid, azealic acid or sebacic acid. The dimer acid is preferably derived from two molecules of stearic acid or oleic acid. Suitably, R2 represents a hydrocarbon group that contains 4-42 carbon atoms, preferably 4-40 carbon atoms and more preferably 4-36 carbon atoms Suitable examples of dimer acids include dicarboxylic acids that have been derived from two monomers of fatty acids that each contain 14 to 22 carbon atoms such as oleic acid, behenic acid, palmleic acid, linoleic acid, stearic acid or linoleinic acid. Preferably, the dimer acid has been derived from two monomers of oleic acid, behenic acid, palmoleic acid, linoleic acid, stearic acid, linoleinic acid, and any combination thereof. Preferably, the dimer acid has been derived from stearic acid or oleic acid. More preferably, the dimer acid is preferably derived from two molecules of stearic acid or oleic acid. The diacid is suitably selected from the group consisting of Suberic acid, Pimelic acid, adipic acid, azealic acid, sebacic acid and brassilic acid. The diacid is in that case prefereably adipic acid, azealic acid or sebacic acid.

Suitably, use is made of dimer acids or trimer acids that are obtained from polymerization of fatty acids. Polymerized fatty acids are typically a mixture of structures, where individual molecules may be saturated, unsaturated, or cyclic. Typically, unsaturated fatty acids are used to form dimer acids, and these include oleic acid, linoleic acid, and linolenic acid. Following the polymerization process, dimer acids may be hydrogenated to remove remaining unsaturation from the hydrocarbon chain. In the dimer acids or trimer acids to be used in accordance with the present invention the two or three carboxylic acid groups are present in the different fatty acid chains of which the dimer acid or trimer acid consists. Hence, these dimer acids and trimer acids differ essentially from diacids or triacids in which two or three carboxylic acid groups are respectively present in one single chain.

In a particularly attractive embodiment of the present invention, the ester terminated oligomer contains both R2 hydrocarbons groups that are derived from one or more dimer acids and one or more diacids, and the molar ratio (A/B) between R2 hydrocarbons groups that are derived from dimer acids (A) and the R2 hydrocarbon groups that are derived from diacids (B) is larger than 1, preferably larger than 2, and more preferably in the range of from 2.5-2.9.

Preferably, the ester terminated oligomer contains one type of dimer acid and one type of diacid.

Preferably, at least 50% of the R2 hydrocarbon groups are derived from a dimer or trimer. An important aspect of the ester-terminated oligomer used herein is its use in lubricating compositions containing low polarity lubricating base oils.

Preferably, R2 represents a hydrocarbon group containing 4-44 carbon atoms. R2 is preferably selected from a C4-42 hydrocarbon group. Preferably, R2 represents a hydrocarbon group containing 28-44 carbon atoms. Preferably, at least 50% of the R2 hydrocarbon groups present in the ester terminated have 30-42 carbon atoms.

The ester-terminated oligomers may also be derived from carboxylic acids which contain less than 28 carbon atoms. Grease compositions of the present invention comprise oligomers that may be derived from carboxylic acids which contain 4-16 carbon atoms, preferably 4-12 carbon atoms, and more preferably 6-9 carbon atoms. Preferably, the carboxylic acid from which the ester terminated oligomer is derived consists of less than 50 wt. %, more preferably less than 30%, and more preferably less than 12 wt. % of these shorter carboxylic acids.

R3 represents a hydrocarbon group containing 2-9 carbon atoms. The hydrocarbon group may be a straight or branched hydrocarbon group; the hydrocarbon group may be a single chain hydrocarbon group or a multiple chain hydrocarbon group; the hydrocarbon group may be a saturated or unsaturated hydrocarbon group; and/or, the hydrocarbon group may be a substituted or a non-substituted hydrocarbon group. In case the hydrocarbon group is a substituted hydrocarbon group the hydrocarbon group may contain an additional functional group such as for instance alcohol, acid and/or an amine group. Preferably, R3 represents an unsubstituted hydrocarbon group. Preferably, R3 represents a hydrocarbon group which is derived from a diamine or triamine. R3 is selected independently from an organic groups containing at least 2 carbon atoms in addition to hydrogen atoms, an optionally containing one or more oxygen and nitrogen atoms.

Suitable examples of diamines include ethylene diamine, 1,2-propylene diamine and 1,3-propylene diamine, tetramethylene diamine, hexamethylene diamine, octamethylene diamine, 1,2-diaminocyclohexane, 1,3-bis(aminomethyl)cyclohexane, diphenylethylene diamine, ortho, meta phenylenediamine, 2,5-diaminotoluene dimethyl-4-phenylenediamine, N,N'-di butyl-1,4-phenelyenediamine, 4,4-diaminobiphenyl, and 1,8-diaminonaphthalene, and any combination thereof. Preferably, the diamine is ethylene diamine, hexamethylene diamine, 1,2-propylene diamine and 1-3-propylene diamine, or ortho-/meta-phenylene diamine, and any combination thereof. More preferably, the diamine is ethylene diamine or hexamethylene diamine.

Suitable examples of triamines include polyoxypropylenetriamine polyetheramine, and Glyceryl poly(oxypropylene) triaminepolyetheramines, with weight average molecular weights of 3000 to 5000 Dalton, or any combination thereof.

Suitably, R3 represents a hydrocarbon group that contains 2-9 carbon atoms, preferably 2-6 carbon atoms and more preferably 2-3 carbon atoms.

The ester terminated oligomer to be used in accordance with the present invention has suitably an acid number of less than 50, preferably less than 30, and more preferably less than 15.

The molecular weight of the ester terminated oligomer is suitably in the range of from 900-23300 Dalton, preferably in the range of from 920-23250 Dalton, and more preferably in the range of from 934-23221 Dalton.

The ester-terminated oligomer in accordance with the present invention is an oligomer having ester end groups. The ester terminated polymer to be used in accordance with the present invention can suitably be derived from a two-steps process, in which in a first step an excess of carboxylic acid selected from the group consisting of diacids, triacids, dimer acid and trimer acids, is reacted with an amine selected from the group consisting of diamines and triamines, to form an acid-terminated oligomer. In order to establish this, use is made of a molar excess of the acids. In a second step, the product obtained in the first step is subsequently reacted with a monoalcohol to form the ester terminated polyamide.

The method for preparing ester-terminated oligomers comprises the reaction of a molar excess of carboxylic acid with an amine such as a diamine or triamine. The condensation product thus formed is then reacted with a monoalcohol.

Preferably, the ester-terminated oligomers are formed upon reaction of a dimer acid, a diacid, a diamine and a monoalcohol. The dimer acid, the diacid and the diamine will first react, whereafter the product obtained will be reacted with monoalcohol. In order to ensure that acid end groups will react with the monoalcohol, a molar excess of acids is used in the first step.

In such an embodiment, the repeating units of the oligomer will be combinations of monomers of the diacid, the dimer acid and the diamine, and the ester end group is derived from acid end groups and the monoalcohol. In such an embodiment, the monomers of the diamine are suitably present in an amount in the range of from 1-20 wt %, preferably in the range of from 4-8 wt %, based on the total weight of the ester terminated oligomer. The monomers of the dimer acid are suitably present in an amount in the range of from 35-75 wt. %, preferably in the range of from 55-70 wt. %, based on total weight of the ester terminated oligomer; and the monomers of the diacid are suitably present in an amount in the range of from 2-40 wt %, preferably in the range of from 2.5-9.5 wt. %, based on total weight of the ester terminated oligomer.

When both monomers of a dimer acid and a diacid are present, the number of the monomers of the dimer acid will suitably be larger than the number of the monomers of the diacid.

The ester terminated oligomer to be used in accordance with the present invention comprises a number of repeating units which are obtained from the condensation reaction of a carboxylic acid and an amine. The number of repeating units is in the range of from 1-20. Preferably, n is an integer in the range of from 2 to 14, more preferably an integer in the range of from 2 to 10, and even more preferably in the range of from 2 to 8.

The weight average molecular weight ratio between the R1-O groups used and the final condensation product obtained is at least between 0.010-0.50, and preferably in the range of from 0.011-0.30.

The molar ratio between the R2 hydrocarbon groups that are derived from a diacid and the R3 hydrocarbon groups that are derived from a diamine is preferably at least between 0.30-0.40 and more preferably in the range of from 0.36-0.38.

The thickener to be used in the present grease composition comprises a polymer which is a polyolefin. Suitable examples of polyolefins include polyethylene, polypropylene, polyisoprene or polybutadiene, poly(styrene-butadiene)

and poly(ethylene-propylene-diene). Preferably, the polyolefin is a polyethylene, polypropylene, polyisoprene or a polybutadiene. Mixtures of two or more of these polyolefins can be used.

Preferably, the polymer is a polymer of propylene. The polymer of propylene preferably comprises a first component and a second component, with the first component having a higher weight average molecular weight than the second component. Preferably, the polymer of propylene comprises a high molecular weight component and a low molecular weight component, characterized in that the polymer of propylene comprises a mixture of (1) a (co- or homo-) polymer of propylene with a weight average molecular weight of more than 200,000, preferably 200,000-350,000, and (2) a (co- or homo-) polymer of propylene with a weight average molecular weight of less than 200,000, preferably less than 100,000, more preferably 50,000-100,000.

The weight ratio between the high molecular weight component and the low molecular weight component in the polymeric thickener can be 1:40-3:1, suitably 1:40-1:1, preferably 1:40-1:5, more preferably 1:25-1:15, and most preferably 1:18-1:20. Preferably, the (co- or homo-) polymer of propylene with a weight average molecular weight of less than 100,000 is a polypropylene homopolymer. Preferably, the (co- or homo-) polymer of propylene with a weight average molecular weight of more than 200,000 high molecular weight component is a polypropylene homopolymer or a propylene/ethylene-copolymer.

According to the present invention, the low molecular weight component is preferably a polypropylene homopolymer, more preferably a polypropylene homopolymer with a melt flow rate of 500-1500 dg/min, especially 750-1250 dg/min. as determined by test ASTM D 1238 L.

The high molecular weight component preferably has a melt flow rate (ASTM D-1238) of 1.5-15, more preferably 1.5-7, especially 3-5.

The low molecular weight component is preferably a polypropylene homopolymer.

Preferably, the high molecular weight component is a polypropylene homopolymer or a propylene/ethylene-copolymer.

In another suitable embodiment of the present invention, the grease composition may be based on the low molecular weight component only. In this case, the high molecular weight component is omitted.

As indicated before, the grease composition of which the grease particles to be used in accordance with the present invention are formed may comprise one or more different polyolefins. For instance, the thickener may contain a polymer of ethylene and a polymer of propylene. Preferably, the polymer of the thickener consists mainly of a polymer of propylene, i.e. the polymer consists of more than 50 wt. % of a polymer of propylene, preferably more than 80 wt. %, and more preferably more than 95 wt. % of a polymer of propylene, based on the total amount of polymer in the grease composition.

In addition, the present invention relates to a method for preparing the grease composition according to any one of claims 1-9, comprising the steps of:

(a) mixing the ester-terminated oligomer, the polymer and the lubricating base oil in any possible order at a temperature above the melting points of the oligomer and the polymer; and (b) cooling the mixture as obtained in step (a) to a temperature in the range of from 0-120° C. in less than 3 minutes.

Step (a) can suitably be carried out at a temperature in the range of from 150-250° C., preferably in the range of from 170-230° C., more preferably in the range of from 190-210° C. Step (a) can be carried out by mixing the polymer, the ester-terminated oligomer and the lubricating base oil in a manner known per se, which can optionally involve the use of suitable solvents. The polymer and ester-terminated oligomer are mixed with the lubricating base oil and optionally one or more additives. After the polymer and ester-terminated oligomer are dissolved in the lubricating base oil and optionally additives have been added, the mixture so obtained is cooled from the mixing temperature to a temperature in the range of 0-120° C. in less than 3 minutes. Preferably, the mixture obtained in step (b) is cooled in step (b) to a temperature in the range of from 10-100° C., more preferably in the range of from 15-35° C., even more preferably to room temperature. Suitably, the cooling in step (b) is carried out in a period of time between 1 sec.-2 min., preferably 10 sec.-1 min., more preferably about 5-15 sec. This rapid cooling process, which forms an important aspect of forming the grease composition will be indicated hereinafter as "quenching". The quenching of the mixture as obtained in step (a) can be carried out, for instance, by pouring the grease composition on a metal plate, although any other suitable rapid cooling method may also be used, such as spraying. The quenching process has a major influence on the structure of grease composition, giving significant improvement of the properties of the final liquid lubricating oil compositions compared to both conventional lubricating oil compositions. The mixing process is preferably carried out under a protective atmosphere, such as a nitrogen gas flow, in order to avoid oxidation of the polymer components and the oils during heating.

The preparation of the present grease composition is preferably carried out under a protective atmosphere, such as a nitrogen gas flow, in order to avoid oxidation of the oils during heating.

The grease composition has a sponge-like structure, which gives the grease composition its appearance and structure. The lubricating base oil is kept within the pore-like spaces within the sponge-like structure. As can be seen from scanning electron micrographs (SEM) photographs, sponge-like-structure is very irregular with large pores as well as very small pores. The above indicated quenching of the present grease composition provides a grease composition with a smoother and more uniform structure. Accordingly, the present invention also relates to a grease composition obtainable by the method according to the present invention.

The present invention further relates to the use of a grease composition according to the present invention for lubricating a mechanical component having a metal surface. In addition, the present invention relates to the use of the present liquid lubricating oil composition for protecting a mechanical component having a metal surface against corrosion, wear and/or fretting. Suitably, the mechanical component comprises a bearing, bearing component or gear box component. The present invention further relates to a grease composition obtainable according to the method of the invention.

The lubricating base oil to be used in the present grease composition may be selected from the group consisting of mineral base oils and synthetic base oils. Mineral base oils are derived from crude oils and are either formulated on the basis of aromatic, paraffinic and/or naphthenic base oils.

Further, a wide range of synthetic base oils can be used and include for instance esters, poly-alpha-olefins and polysiloxanes.

The lubricating base oil to be used in accordance with the present invention may also comprise a base oil blend. Suitably, blends of mineral base oils and/or synthetic base oils may be used.

The lubricating base oil to be used in the grease composition of the invention is one which may ordinarily be used as the base oil of a lubricating oil or as the base oil of a grease, but will suitably have a kinematic viscosity at 40° C. in the range of from 5-1000 cSt, preferably in the range of from 10-400 cSt.

Also the lubricating base oils may be any lubricating oils known per se such as mineral oils, synthetic hydrocarbons, ester oils, vegetable oils and mixtures thereof.

In the context of the present application the kinematic viscosity measurements at 40° C. are carried out in accordance with DIN 51562/1.

Furthermore, additives known per se may be incorporated in the present grease composition. The grease composition may additionally comprise at least one additive component which is selected from the group consisting of antioxidants, corrosion inhibitors, anti-wear agents and pressure tolerance-increasing additives, and wherein the total content of the additive component(s) is in the range between 0.1 and 15% by weight, and preferably between 0.5 and 10% by weight, based on the total weight of the grease composition. The present invention also relates to the present grease composition which further comprises one or more anti-wear, anti-corrosion and/or anti-fretting additives.

An advantage of the present grease composition is that the amount of such additives, in particular aggressive additives, can be decreased or even be avoided, whilst still very attractive lubricating properties are established.

EXAMPLES

Example 1 (According to the Invention)

An ester-terminated polyamide was prepared by reacting 61 gram of a dimer and 7.4 gram of azealic acid with 5.9 gram of ethylene diamine. The acids were mixed under heating at a temperature of 95° C. until the mixture was homogeneous. Ethylene diamine was added slowly to the mixture dropwise with constant stirring under dry nitrogen supply. 25.7 gram of stearyl alcohol was added to the reaction vessel. After the completion of monoalcohol addition, the temperature of reaction mixture was raised to 180° C. and maintained for 3 hours. The temperature of the reaction mixture was raised to 205° C. and kept under constant dry nitrogen supply and constant stirring for 30 minutes. The mixture was discharged onto a metal plate and cooled to room temperature. In a reaction vessel, 13 gram of the ester-terminated oligomer polyamide was heated to its melting point of around 160° C. in the presence of dry nitrogen and under continuous stirring. 80 gram of a lubricating ester base oil Priolube 1426 (available from Croda) was added slowly and the temperature was not allowed to cool down to below 145° C. The temperature was raised to 160° C., after which 6.65 gram of a low molecular weight homo-polymer of polypropylene was added, and 0.35 gram of a high molecular weight co-polymer of a polypropylene were added. The low molecular weight homo-polymer of polypropylene was Borflow HL508 FB, obtained from Borealis. The high molecular weight co-polymer of polypropylene was Moplen EP300K, a poly(ethylene-co-propylene) block co-polymer, obtained from Lyondell Basell. The temperature of the mixture was then raised to 180° C. and kept under dry nitrogen and continuous stirring for 60 minutes. The temperature was then further raised to 205° C. and kept under dry nitrogen, whilst the mixture was continuously stirred for 30 minutes. The mixture so obtained was then cooled to room temperature within 10 seconds by means of quenching, executed by discharging the mixture in a thin layer onto a solid metal plate at room temperature. The properties of the grease obtained are listed in Table 1.

Example 2 (According to the Invention)

In accordance with the procedure described in Example 1, a grease composition was prepared wherein the lubricating base oil was a mineral base oil (Cirkan C68, available from Total Lubricants). The properties of the grease obtained are listed in Table 1.

Solubility in Oil: Completely Soluble (Visual Appearance)

Example 3

In accordance with the procedure in Example 2, a homogeneous, heated mixture of ester-terminated polyamide and lubricating mineral oil was prepared, and kept under stirring and nitrogen at 205° C. In the final step, the mixture was removed from the heating source and allowed to cool to room temperature without any quenching and any time limit, in more than 30 minutes.

A grease structure was not formed. At the early stage there was little formation of gel structure and at later stage gel was separated into oil and oligomer. This example shows that cooling by quenching during the preparation of a grease composition in step (b) of the method of the present invention is of essential importance.

Example 4

In a reaction vessel, 20 gram of the ester-terminated polyamide used in Example 1 was heated to its melting point of around 160° C. in the presence of dry nitrogen and under continuous stirring. 80 gram of lubricating ester base oil Priolube 1851 (available from Croda) was added slowly and the temperature was not allowed to cool down to below 145° C. The temperature of the reaction mixture was then raised to 180° C. and kept under dry nitrogen and continuous stirring for 60 minutes. The temperature was then further raised to 205° C. and kept under dry nitrogen, whilst the mixture was continuously stirred for 30 minutes. The mixture so obtained was then cooled to room temperature within 10 seconds by means of quenching, executed by discharging the mixture in a thin layer onto a solid metal plate at room temperature. The properties of the grease obtained are listed in Table 1.

Solubility in Oil: Completely Soluble (Visual Appearance)

Example 5

In a reaction vessel, 435 gram of a lubricating mineral oil (Cirkan C68 from Total Lubricants) was mixed with 61.75 gram of the low molecular weight homo-polymer of polypropylene as used in Example 1, and 3.25 gram of the high molecular weight co-polymer of propylene as used in Example 1. The temperature of the mixture was then raised to 180° C. and kept under dry nitrogen and continuous stirring for 60 minutes. The temperature was then further raised to 205° C. and kept under dry nitrogen, whilst the mixture was continuously stirred for 30 minutes. The mixture so obtained was then cooled to room temperature within 10 seconds by means of quenching, executed by discharging the mixture in a thin layer onto a solid metal plate at room temperature. The properties of the grease obtained are listed in Table 1.

TABLE 1

| | Example 1 | Example 2 | Example 3 | Example 4 | Example 5 |
|---|---|---|---|---|---|
| Oligomer content (wt. %) | 13 | 13 | 13 | 20 | 0 |
| Polymer content (wt. %) | 7 | 7 | 7 | 0 | 13 |
| Lubricating base oil type | Ester | Mineral | Mineral | Mineral | Mineral |
| Base oil viscosity (cSt at 40° C.) | 65 | | 68 | | |
| Cooling method | Quenching | Quenching | Slow cooling | Quenching | Quenching |
| Physical appearance | Clear Semi-solid homogeneous | Clear Semi-solid homogeneous | Turbid Semi-liquid Separated | Clear Semi-solid Homogeneous | Opaque Semi-solid Homogeneous |
| Penetration (mm/10) | 207 | 215 | N.A. | 283 | 270 |
| Consistency (NLGI grade) | 3-4 | 3-4 | N.A. | 2 | 2 |
| Oil separation (%) | 1.6 | 1.1 | N.A. | 11.5 | 7.5 |
| Dropping point (° C.) | 179 | 145 | N.A. | 128 | 145 |

Examples 1 and 2 represent greases in accordance with the present invention, wherein the thickener comprises an ester-terminated oligomer and a polymer (polypropylene in the given examples). Example 4 represents a grease wherein the thickener comprises only an ester-terminated oligomer; Example 5 is a polypropylene-thickened grease containing no ester-terminated oligomer. Example 3 failed to produce a grease structure, due to the slow cooling rate during preparation, and tests could not be performed.

The remaining examples were subjected to an oil separation test according to DIN 51817, to determine oil bleeding. Consistency was measured using a standard cone penetration method (DIN 51804) and the dropping point of the grease was measured according to DIN 51801.

The results of the oil separation test are particularly interesting. The polypropylene-thickened grease of Example 5 has better oil-bleeding characteristics than the oligomer-thickened grease of Example 4, and it might have been expected that a grease having a "hybrid" thickener comprising both components would exhibit an oil bleeding rate of between 7.5% and 11.5%. Surprisingly, the greases of Examples 1 and 2 exhibit considerably lower oil bleeding, having lost only 1.6% and 1.1% by weight of oil after conclusion of the test. The advantageous oil bleeding characteristics of the "hybrid" greases according to the invention are thus clear.

What is claimed is:

1. A grease composition comprising a mixture of:

a lubricating base oil, an ester-terminated polyamide, and at least one polyolefin thickener, wherein:

the ester-terminated polyamide has the formula:

$$R1\text{-}O\text{-}CO\text{-}R2\text{-}CO\text{-}[NH\text{-}R3\text{-}NH\text{-}CO\text{-}R2\text{-}CO]_n\text{-}O\text{-}R1,$$

wherein:

each R1 is independently a linear or branched, saturated or unsaturated, substituted or unsubstituted hydrocarbon group containing 4-22 carbon atoms, each R2 is independently a linear or branched, saturated or unsaturated, substituted or unsubstituted hydrocarbon group containing 4-42 carbon atoms, each R3 is independently a linear or branched, saturated or unsaturated, substituted or unsubstituted hydrocarbon group containing 2-9 carbon atoms, n is an integer in the range of 1-20.

2. The grease composition according to claim 1 comprising:

(a) 75 to 90 wt.% of the lubricating base oil;

(b) 1 to 19 wt.% of the ester-terminated polyamide; and (c) 1 to 19 wt.% of the at least one polyolefin thickener, all weights being based on the total weight of the grease composition.

3. The grease composition according to claim 1 comprising:

(a) 76-84 wt.% of the lubricating base oil;

(b) 11-15 wt.% of the ester-terminated polyamide; and (c) 5-9 wt.% of the at least one polyolefin thickener, wherein all weights are based on the total weight of the grease composition.

4. The grease composition according to claim 1, wherein n is 2-14.

5. The grease composition according to claim 1, wherein the at least one polyolefin thickener comprises one of: polyethylene, polypropylene, polyisoprene or polybutadiene.

6. The grease composition according to claim 1, wherein the at least one polyolefin thickener comprises a mixture of:

a (co- or homo-) polymer of polyolefin having a weight average molecular weight of more than 200,000; and a (co- or homo-) polymer of polyolefin having a weight average molecular weight of less than 100,000.

7. The grease composition according to claim 6, wherein the (co- or homo-) polymer of propylene having a weight average molecular weight of less than 100,000 is a polypropylene homopolymer.

8. The grease composition according to claim 6, wherein the (co- or homo-) polymer of propylene having a weight average molecular weight of more than 200,000 is one of: a polypropylene homopolymer or a propylene/ethylene-copolymer.

9. The grease composition according to claim 6, comprising:

(a) 76 -84 wt.% of the lubricating base oil;

(b) 11-15 wt.% of the ester-terminated polyamide; and (c) 5-9 wt.% of the mixture of the polyolefins, wherein all weights are based on the total weight of the grease composition.

10. The grease composition according to claim 9, wherein n is 2-14.

11. The grease composition according to claim 10, wherein:

the (co- or homo-) polymer of propylene having a weight average molecular weight of less than 100,000 is a polypropylene homopolymer; and the (co- or homo-) polymer of propylene having a weight average molecular weight of more than 200,000 is a propylene/ethylene-copolymer.

12. The grease composition according to claim 11, wherein:

the polypropylene homopolymer has a weight average molecular weight of 50,000-100,000; and the propylene/ethylene-copolymer has a weight average molecular weight of 200,000-350,000.

13. The grease composition according to claim 12, wherein the polypropylene homopolymer and the propylene/ethylene-copolymer are present in a weight ratio in the range of 1:25-1:15.

14. The grease composition according to claim 13, wherein the propylene/ethylene-copolymer has a melt flow rate of 1.5-7 as measured according to ASTM D-1238.

15. The grease composition according to claim 14, wherein:

the -NH-R3-NH- group is derived from one of an ethylene diamine or a hexamethylene diamine;

the -CO-R2-CO- group is derived from a mixture of a dimer acid composed of two molecules of unsaturated fatty acids and a diacid selected from the group consisting of an adipic acid, an azelaic acid or a sebacic acid; and R1 is derived from one of stearyl alcohol or oleyl alcohol.

16. The grease composition according to claim 15, wherein:

at least 50% of the R2 groups have 30-42 carbon atoms; and less than 30% of the R2 groups have 4-12 carbon atoms.

17. The grease composition according to claim 16, wherein:

R1 is an unsubstituted, saturated, linear hydrocarbon having 18 carbons,

R3 is an unsubstituted, saturated, linear hydrocarbon having 2 carbons, less than 30% of the R2 groups are an unsubstituted, saturated, linear hydrocarbon having 7 carbons.

18. A method for manufacturing the grease composition according to claim 1, comprising:

mixing the ester-terminated polyamide, the at least one polyolefin thickener and the lubricating base oil in any order and holding the mixture at a temperature above the melting point of the ester-terminated polyamide, and cooling the resulting mixture to 0-120° C. in less than 3 minutes.

19. The method according to claim 18, wherein the mixture is held at a temperature of 190-210° C. and then the resulting mixture is cooled to a temperature of 15-35° C. within 5-15 seconds.

20. The method according to claim 19, wherein, prior to the mixing step, the ester-terminated polyamide is prepared by mixing a dimer acid, a diacid, a diamine and a monoalcohol and allowing them to react.

* * * * *